US005084609A

United States Patent [19]

Saber

[11] Patent Number: 5,084,609

[45] Date of Patent: Jan. 28, 1992

[54] TRIGONOMETRIC SLIDE RULE

[76] Inventor: Gilbert F. Saber, 5 Clarissa Rd., Chelmsford, Mass. 01824

[21] Appl. No.: 411,019

[22] Filed: Sep. 22, 1989

[51] Int. Cl.[5] ..... G06G 1/02

[52] U.S. Cl. ..... 235/70 A; 235/89 R

[58] Field of Search ..... 235/69, 70 R, 70 A, 235/78 M, 88 M, 89 R

[56] References Cited

U.S. PATENT DOCUMENTS

| | | | |
|---|---|---|---|
| 3,082,948 | 3/1953 | Simini | 235/78 M X |
| 3,130,905 | 4/1964 | Hsiao | 235/89 R |
| 3,372,869 | 3/1968 | Motte et al. | 235/70 R |
| 3,473,731 | 10/1969 | Kurland | 235/70 A X |
| 3,563,456 | 2/1971 | Hendricks | 235/89 R |
| 4,476,380 | 10/1984 | Sampson | 235/89 R X |

*Primary Examiner*—Brian W. Brown
*Attorney, Agent, or Firm*—John P. Halvonik

[57] ABSTRACT

The invention relates to an improved slide rule type of apparatus that provides visual solutions to trigonometric problems. The invention provides a cheaper to make and easier to read trigonometric slide rule.

3 Claims, 2 Drawing Sheets

TRIGONOMETRIC SLIDE RULE

BACKGROUND OF THE INVENTION

This invention relates generally to a slide rule-type of calculator for solving trigonometric problems. The term "slide rule" is meant to indicate that solutions to trigonometric problems can be found by manipulation of the various parts of the apparatus and solutions found by noting where on the scale in question various lines have intersected it.

Many types of mathematical problems can be solved either algebraically or graphically. Although algebraic techniques provide greater flexibility in the solution of general problems, graphical techniques offer distinct advantages in certain instances. For example, in the field of education, graphical approaches to problem solution are frequently more perceptable to the average student and therefore provide a more tangible understanding of the problem solved. Also, in certain instances, graphical solutions can be obtained more rapidly than algebraic solutions or can be used as a supplemental check thereof.

The usefulness of graphics is particularly significant in the science of trigonometry wherein problems involving the right triangle lend themselves readily to graphical solution. The angles and sides of right triangles can be measured very quickly and with very little effort. Consequently, various types of mechanical computers have been proposed for use in obtaining graphical solutions to trignometric problems. Devices of this type are disclosed, for example, in U.S. Pat. Nos. 3,014,646 and 3,414,190. Although generally useful for trignometric problems, these prior devices have exhibited various drawbacks such as being relatively costly, difficult to manipulate or interpret, etc.

SUMMARY OF THE INVENTION

The mechanical computer of the present invention comprises a support member with a front surface retaining a linear base scale defined by graduations identifying predetermined unit distances from a base origin. A linear height scale having graduations identifying the same predetermined unit distances from a height origin is mounted on the support member and adapted for translational movement along a path wherein the height origin remains perpendicular thereto. Pivotally mounted on the support member at the base origin is a linear hypotenuse scale having graduations also identifying the predetermined unit distances from a hypotenuse origin located at the pivot point. Finally, the front surface of the support member retains, in a position adjacent to the end of the base scale opposite the base origin, a substantially linear angle scale having graduations identfying angles defined by the base and hypotenuse scales. By appropriate manipulation of the hypotenuse and height scales, graphic solutions to trigonometric problems are quickly and easily obtained.

A feature of the invention is the provision on the rear surface of the support plate member of a table of trigonometric functions. This table can be used to obtain algebraic solutions to problems by appropriate manipulation of the hypotenuse and height scales.

It is among the objectives of the present invention to provide a trigonometric slide rule capable of measuring the height, base, hypotenuse and the angle formed by the hypotenuse and the base.

Another objcective of this invention is to provide a trigonomertric slide rule that can be quickly and easily manipulated to provide solutions to trigonometric problems.

Another objective is to provide a trigonomertric slide rule having an angle scale capable of being read without the height scale interfering with the reading.

Still another is to provide a trigonometric slide rule having no more than two of its scales overlapping each other.

Yet another is to provide a trigonometric slde rule having a read out for angles that is outside the area used by the height and base scales.

Another objective is to provide a trigonometric slide rule that is simpler in construction and does not need guide strips, end plates, screws and nuts.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENTS

Figure 2:
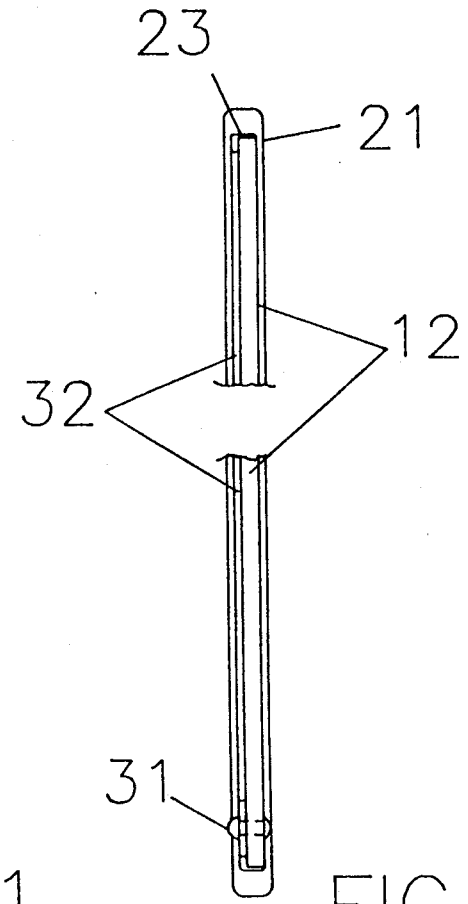
FIG. 2 is an end view of the computer shown in FIG. 1.
Figure 1:
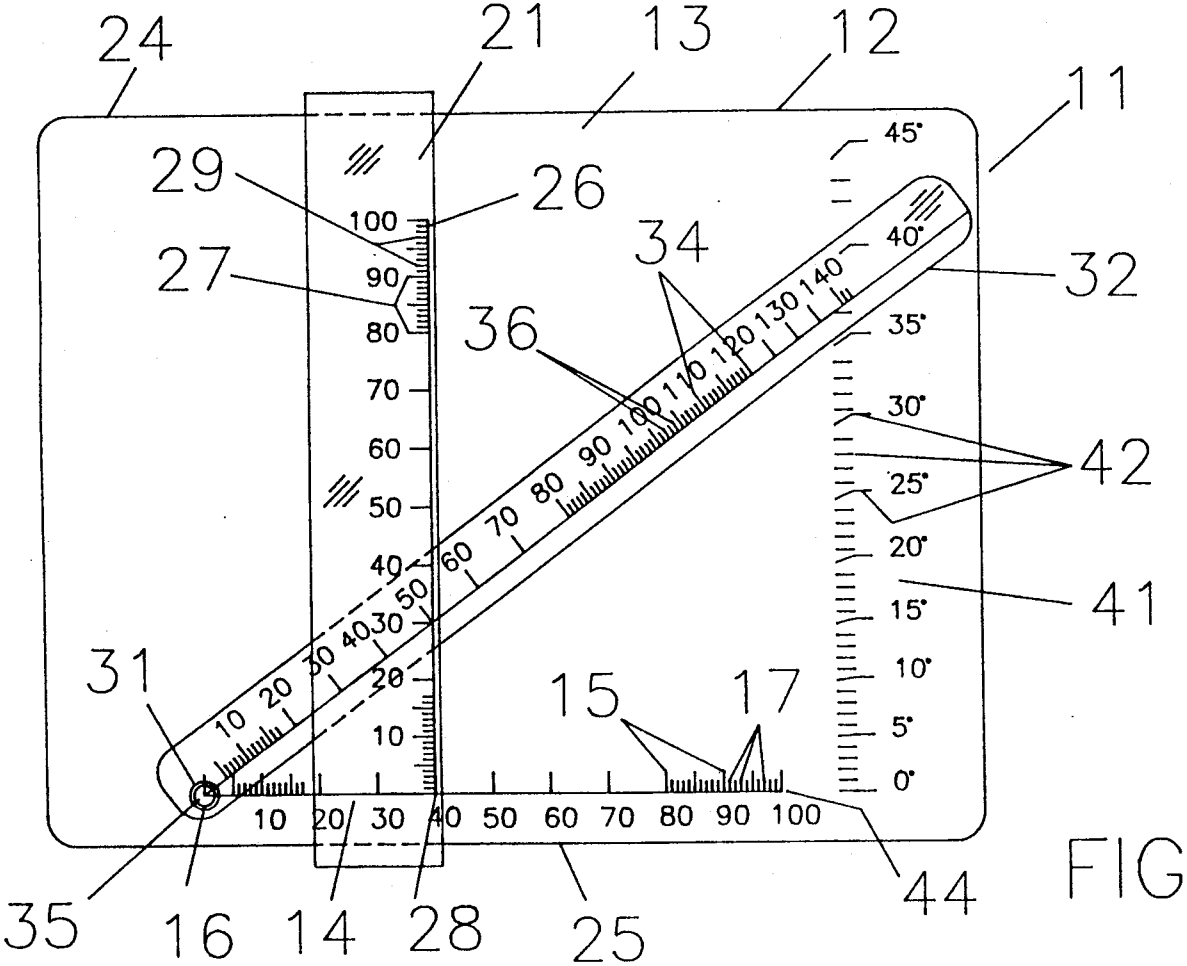
FIG. 1 is a front view of a mechanical computer according to the invention.

Referring now to FIGS. 1 and 2, there is shown a mechanical computer 11 including a support plate member 12 made, for example, or plastic and having a planar front surface 13. Imprinted on the surface 13 is a linear base scale 14 having graduations 15 identifying unit distances 10, 20, 30 . . . 100.

Mounted for movement on the support 12 is a slide member 21 made of a suitable transparent material such as clear plastic. The slide extends completely around the support member 12 providing bearing surfaces 23 that guide movement of the slide 21 so that the height scale remains substantially perpendicular to the base scale and the origin of the height scale is always on the line of the base scale, thus the height can always be read in terms of the distance from the base. The bearing surfaces are preferably made of the same material as the height scale and may be merely extensions of the height scale that extend around the top and bottom edge of the support plate. These allow the height scale to maintain its position with the base scale and also keep the height scale from falling off the support. Printed on the slide 21 is a linear height scale 26 having graduations 27 identifying unit distances 10, 20, 30 . . . 100 from a height origin 28. The unit distances identified by the graduations 27 on the height scale 26 are equal to those identified by the graduations 15 on the base scale 14 and sub-graduations 29 similarly identify unit distances 1, 2, 3 . . . 100. The bearing surfaces 23 maintain alignment between the slide 21 and support member 12 during translational movement between them so that the height scale 26 remains perpendicular to the base scale 14 and the height origin 28 remains in alignment therewith.

Pivotally mounted on the support member 12 by an eyelet 31 is an elongated transparent strip 32 formed, for example, of a suitable clear plastic. The strip 32 is disposed between the slide member 21 and the front face 13 of the support member 12.

Imprinted on the strip 32 is a linear hypotenuse scale 33 having graduations 34 identifying unit distances 10, 20, 30 . . . 150 from a hypotenuse origin 35 coincident with the pivot point 31 and the base origin 16. Again, the unit distances identified by the graduations 34 are equal to those identified by the graduations 27 on the height scale 26 and the graduations 17 on the base scale 14 and sub-graduations 36 identify unit distances 1, 2, 3 . . . 150.

An angle scale 41 is imprinted on the support and is able to measure the angle formed between the base scale 14 and the hypotenuse scale 33 in response to pivotal movement of the hypotenuse scale. The angle scale 41 is substantially perpendicular to the base scale 14 and is disposed beyond the end 44 thereof opposite the base origin 16. For this reason the graduations 42 of the angle scale 41 do not interfere with observation of the height any hypotenuse scales 26, 33 during the graphic solution to problems as described below. Older devices had this problem of overlap from the other scales that led to problems with reading the output on the angle scale and on the other scales.

Figure 3:
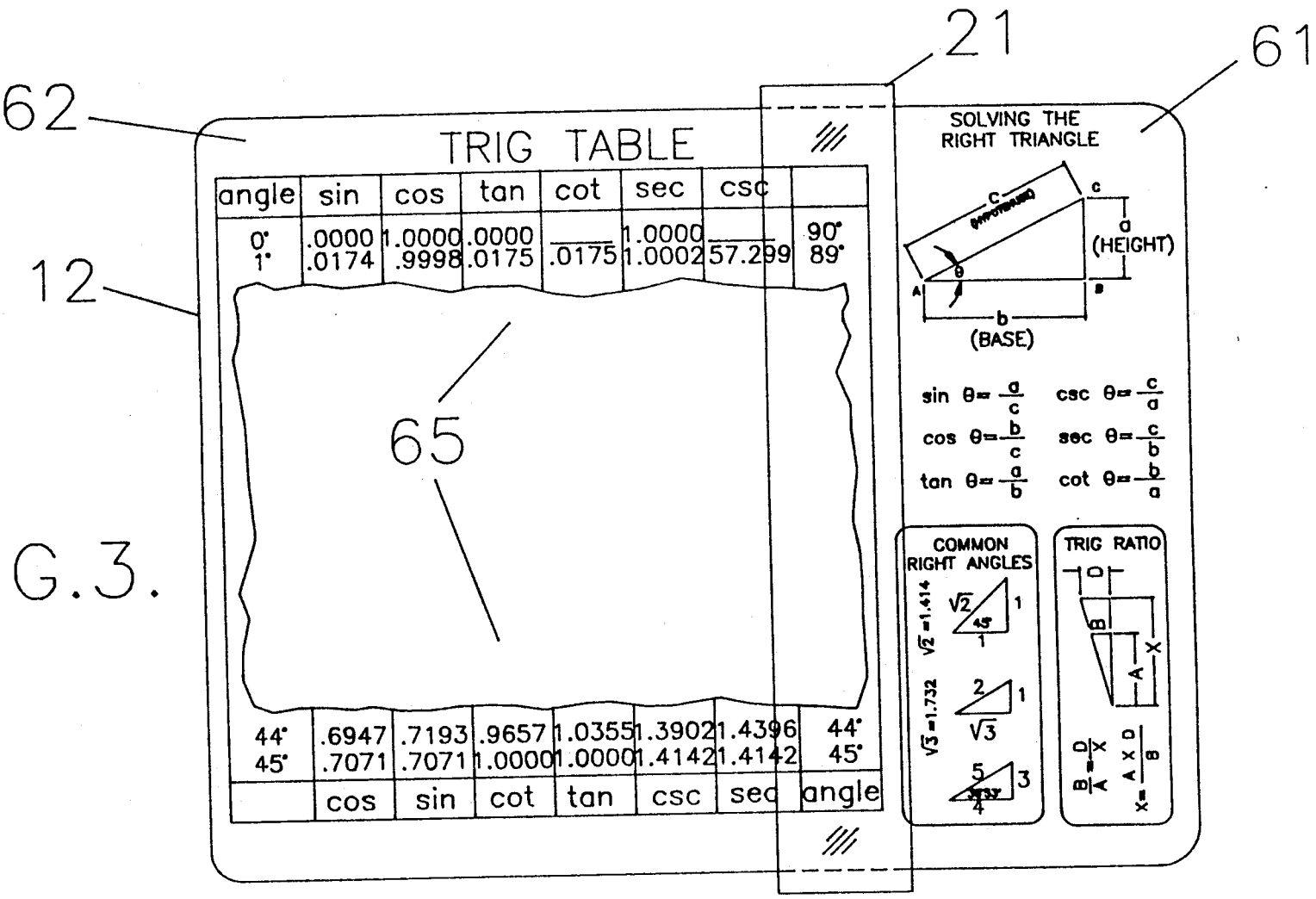
FIG. 3 is a rear view of the mechanical computer shown in FIG. 1.

Operation of the computer 11 can best be illustrated by describing the solution of a few typical problems with reference to the sample triangle 61 (FIG. 3) imprinted on the rear surface 62 of the support member 12.

Problem 1: Solve a right triangle having a base equal to 4 and a height equal to 3.

Solution 1: Referring to diagram 61 in FIG. 3, the problem states that b=4 and a=3. Therefore, the height scale 26 is positioned at the graduation representing 40 on the base scale 14 as shown in FIG. 1 and the hypotenuse scale is aligned with the graduation representing 30 as also shown. The intersection by the height scale 26 of the graduation representing 50 on the hypotenuse scale indicates that the hypotenuse c in the sample problem is equal to 5. Similarly, the intersection by the hypotenuse scale 33 of the angle scale 41 indicates the value of the angle $\phi$ to be almost 37 degrees. Obviously, the value of the angle 1 is 90 degrees less the value determined for the angle $\phi$.

Problem 2: Solve a right triangle having a height equal to 1 and a hypotenuse equal to 2.

Solution 2: Again referring to diagram 61 in FIG. 3, the problem states that a=1 and c=2. Accordingly, the height scale 26 and the hypotenuse scale 32 are manipulated into the positions shown by dashed lines 68 and 69 in FIG. 1 wherein they intersect at a value of 10 on the height scale and 20 on the hypotenuse scale. The resultant intersections between the hypotenuse and angle scales and between the height and base scales indicate, respectively, an angle 0 equal to 30 o and a base (b)=to a little over 1.7 (actually $\div 3 = 1.732$). Again the angle $\Delta$ is the complement of angle $\Delta$, or in this case, equal to 60 degrees.

Problem 3: Solve a right triangle having an angle $\Delta$ equal to 45 degrees and a base equal to 1.

Solution 3: Again referring to diagram 61 in FIG. 3, the hypotenuse scale 33 is positioned so as to intersect the graduation representing 45 degrees on the angle scale 41 as shown by dotted line 71 in FIG. 1. In this case the height scale 32 need not be adjusted since the auxiliary height scale 51 is aligned with the correct value of 100 on the base scale 14. The intersection between the hypotenuse and auxiliary height scales indicates a value of about 1.4 (actually $\div 2$) to the hypotenuse c and 1 for the height a and the angle $\Delta$ is again complementary and also equal in this case to 45 degrees.

It will be apparent from the foregoing that the computer 11 can be used to solve any right triangle in which at least two of the five variables are known. Another feature of the invention is the provision of a table 65 of trigonometric functions on the rear surface 62 of the support member 12. When desired the table 65 can be used in conjunction with trig equations to obtain highly accurate algebraic solutions to problems. The correctness of these solutions can then be quickly verified by solving the same problems graphically as described above. Thus, the front 13 and rear 62 surfaces combine to provide the mechanical computer 11 with a greater overall flexibility for the solution of trigonometric problems.

Obviously, many modifications and variations of the present invention are possible in light of the above teachings. It is to be understood, therefore, that the invention can be practiced otherwise than as specifically described. Preferably the height and hypotenuse scales are made of a clear plastic or similar material. The graduations are thus markings imprinted on the clear scales.

What is claimed is:

1. A mechanical apparatus for solving trigonometric problems comprising:

a support member having a front surface and top and bottom edges, said surface having indicia designating an origin point, said front surface having a printed indicia designating a linear base scale, said base scale starting at said origin point and being substantially parallel to said top and bottom edges and capable of designating predetermined unit distances from said origin point; said front surface having indicia designating a linear angle scale said angle scale, being nearly perpendicular to said base scale and capable of designating an angle defined by said base scale and another line going through said origin point;

a base height scale comprising a flat strip of substantially transparent material having a sliding means at each end, said sliding means capable of keeping said base scale in contact with said support member while allowing said base height scale to slide along said top and bottom edges of said support member, said base height scale having indicia markings to designate predetermined unit distances from said linear base scale, said indicia markings being perpendicular to said linear base scale;

a linear hypotenuse scale comprising a flat strip of substantially transparent material, said strip attached to said support member substantially near said origin point by a pivoting means, said pivoting means capable of allowing said linear hypotenuse scale to slide along said support surface in a movement centered on said origin point so as to form angles with said linear base scale, said angles capable of being measured by said linear angle scale, said linear hypontenuse scale having indicia to designate predetermined unit distances from said origin point.

2. The apparatus of claim 1 wherein said sliding means comprise the top and bottom edges of said base height scale being curled about itself so as to form a space between said edges and a portion of the remainder of said scale, said space capable of fitting around said top and bottom edges of said support member so as to secure said base height scale to said edges of said support member.

3. The apparatus of claim 2 wherein said support member has a rear surface, said surface having indicia designating a table of trigonometric functions.

* * * * *